United States Patent [19]

Kontz

[11] 4,386,988

[45] Jun. 7, 1983

[54] WEB HANDLING APPARATUS

[75] Inventor: Robert F. Kontz, Toledo, Ohio

[73] Assignee: Owens-Illinois, Inc., Toledo, Ohio

[21] Appl. No.: 260,503

[22] Filed: May 4, 1981

[51] Int. Cl.[3] ..... B65H 19/10; B65H 69/06

[52] U.S. Cl. ..... 156/157; 156/502; 156/504; 156/543; 242/58.1; 242/58.4

[58] Field of Search ..... 156/157, 159, 502, 504, 156/505, 538, 543, 260, 539; 242/58.1, 58.4

[56] References Cited

U.S. PATENT DOCUMENTS 3,655,475 4/1972 Stelling, Jr. et al. ..... 156/260

4,196,662 4/1980 Hsu ..... 242/58.4

*Primary Examiner*—Michael G. Wityshyn

*Attorney, Agent, or Firm*—John R. Nelson; M. E. Click; David H. Wilson

[57] ABSTRACT

A web handling apparatus for splicing the terminal end of one roll of web stock to the lead end of a second roll of web stock in an uninterrupted feed to a machine. The first roll web is fed into the machine and a second roll web in parallel relationship to the first is guided by two turning bars laterally and again in parallel and overlying relationship to the first. Thereafter a splicer device joins the second roll to the first roll. The second turning bar is pivotally mounted on a vertical axis and movable vertically such that it can be moved from below the first roll web vertically upwardly and by pivoting about the vertical axis to a position whereat the second turning bar overlies the first roll web. Subsequently, the second roll web will overlie the first web in splicing relationship.

7 Claims, 9 Drawing Figures

WEB HANDLING APPARATUS

This invention relates to web handling apparatus and particularly to apparatus for handling webs which are being fed to a splicing station.

BACKGROUND AND SUMMARY OF THE INVENTION

In the use of webs from supply rolls which are fed to production machines for making or forming the webs into articles, such as articles of expanded plastic, it is necessary to splice the trailing end of the web being supplied from a roll to the leading end of a web which is to be used from another roll without interrupting production of the machine. In the splicing, it is also preferred to have the leading end of the web from the new supply roll to be moved in overlying relation to the web from the first roll so that it may be brought into position adjacent the trailing end of the web from the first roll which is supplying the web.

Accordingly, among the objects of the present invention are to provide a web handling apparatus that will permit the leading end of the web from the new supply roll to be fed to the same side of the web being supplied for splicing at a splicing station; which apparatus is simple and reliable and produces no interruption in the web being fed to the production machines.

The web handling apparatus embodying the invention comprises a first roll support for supporting a web roll for rotation about a horizontal axis, a second roll support for supporting a web roll about a horizontal axis generally parallel and spaced laterally from the first web roll and a splicing station. The first roll support is aligned with the splicing station such that the web from the first roll moves across the splicing station. A pair of turning bars is provided, one of the turning bars having its axis positioned at an acute angle to the longitudinal axis of the web extending from the second roll for changing the direction of the web from the second roll so that it extends transversely toward the path of the web from the first roll and the second turning bar having its axis at an angle to the longitudinal axis of the web from the second roll for receiving the web from the second roll and changing its direction so that the web from the second roll moves longitudinally in the direction of the longitudinal axis of the web from the first roll toward the splicing station. The second turning bar is pivotable about a vertical axis and movable vertically along the vertical axis such that the second bar can be moved from a position below the first web as it moves to the splicing station by pivoting about the vertical axis and movement vertically upwardly and then pivoting about the vertical axis to a position wherein said second bar overlies the first web as it is moving toward the splicing station. This permits the second web to overlie and be moved to the splicing station in overlying relation to the web from the first roll for splicing to the first web.

DESCRIPTION

Figure 1:
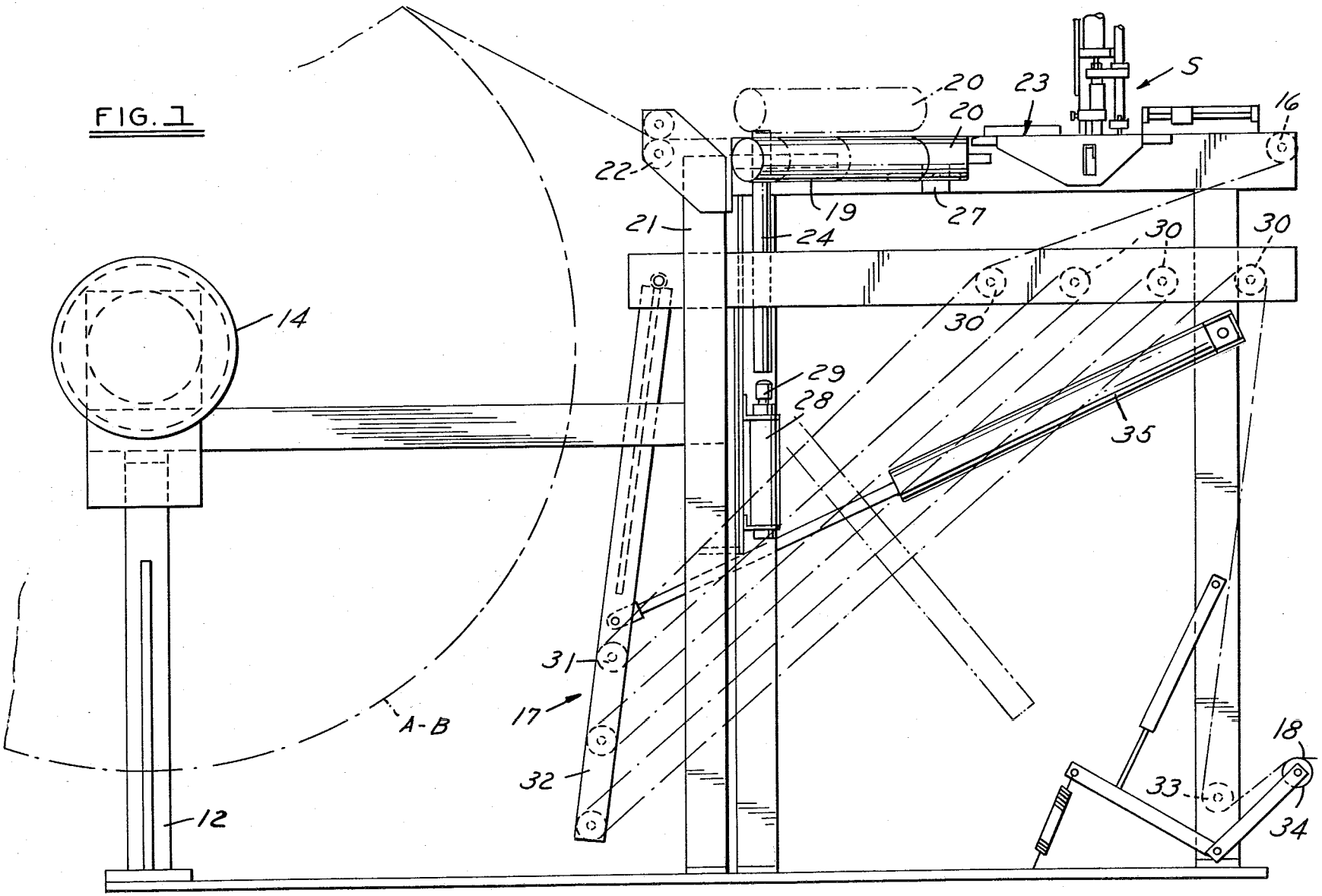
FIG. 1 is a fragmentary side elevational view of an apparatus embodying the invention.
Figure 2:
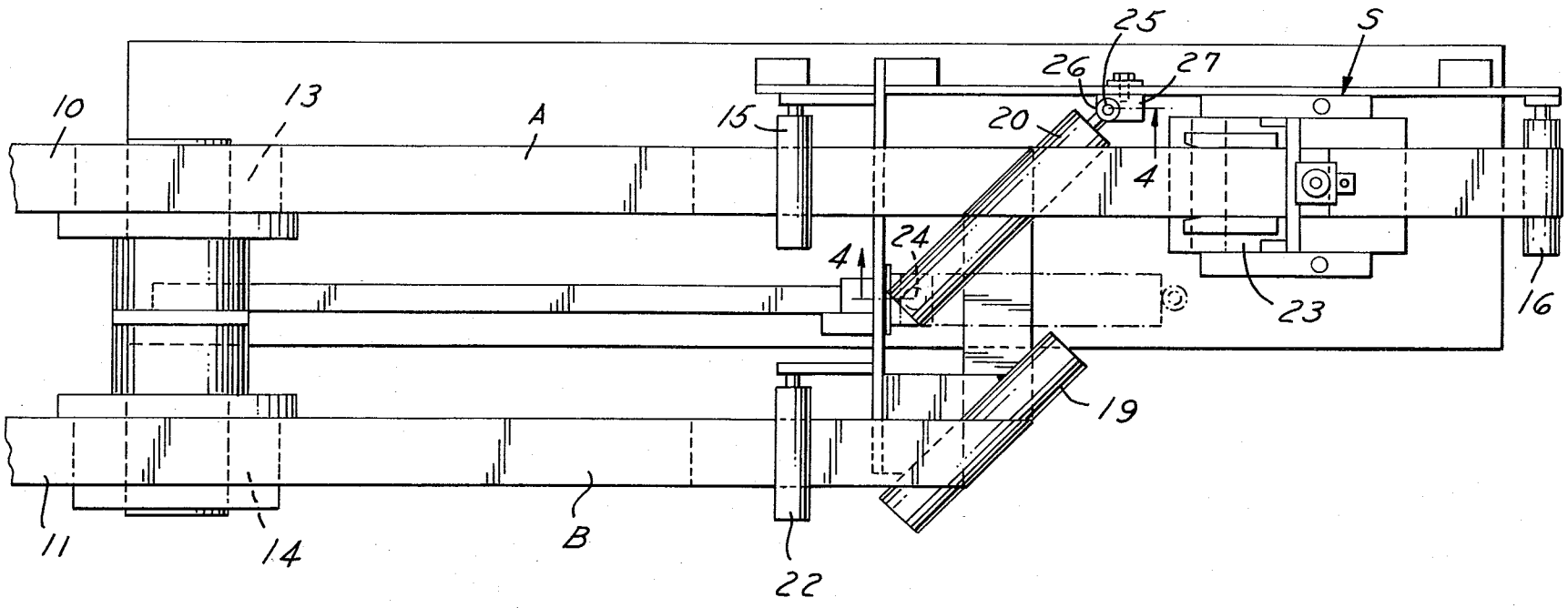
FIG. 2 is a top plan view of the same.

Referring to FIGS. 1 and 2, the web handling apparatus embodying the invention is adapted to guide, selectively, the webs A and B which are being fed from supply rolls 10 and 11, respectively, horizontally to a splicing station S.

As shown in FIGS. 1 and 2, the supply rolls 10 and 11 are mounted on a stand 12 for rotation about coaxial horizontal axes on rollers 13, 14 rotatably mounted on the stand 12. The supply roll 10 is aligned with the splicing station S so that the web A is fed across the station S being guided between inlet rollers 15 and an outlet roller 16. A web being moved across the station S thereafter passes into an accumulating system or festooning apparatus 17 of well known construction so that a supply of the web can be accumulated before it passes as at 18 to the production machine. The festooning apparatus 17 functions to accumulate a length of web so that any interruption in the movement of the web at the splicing station to permit the splicing does not interfere with production.

In order to supply the web B to the production machine and also move it across the splicing station S, horizontal cylindrical turning bars 19, 20 are positioned on the frame 21 that supports the splicing apparatus. The turning bar 19 is positioned with its axis at an angle of 45° to the longitudinal axis of web B and functions to change the direction of the web B so that after passing through the guide rollers 22, and over turning bar 19, web B moves transversely. Turning bar 20 is normally positioned so that its axis is parallel to bar 19 so that it redirects the web B so that web B thereafter moves longitudinally past the splicing station S to the festooning or accumulating apparatus.

When the web B is being fed across the splicing station, the upper surfaces of the guide bars 19, 20 are parallel to the horizontal or upper surface or plane 23 of the splicing station (FIG. 1).

When a web B is being fed, in order to splice the leading end of the web A from a fresh roll to the trailing end of the web B, the web A is manually threaded through the guide rollers 15 onto the upper surface of the web B that is being fed to the splicing station S where it is in position for splicing to the upper surface of the web B.

Figure 4:
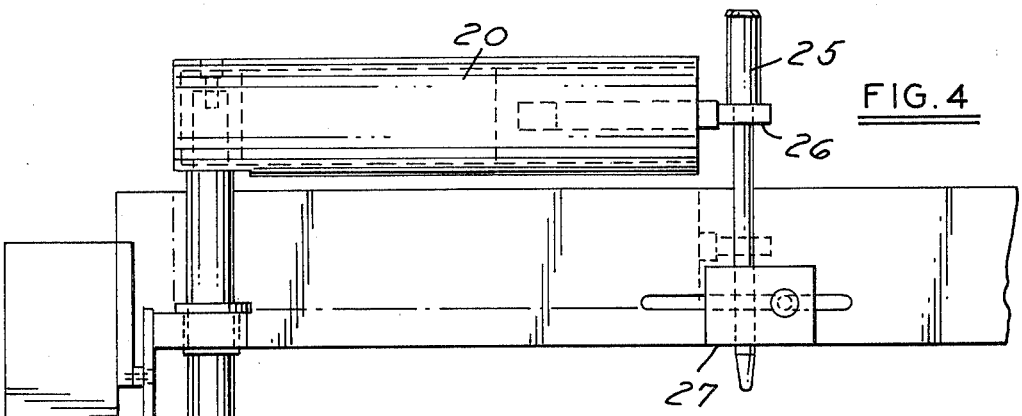
FIG. 4 is a fragmentary view taken along the line 4—4 in FIG. 2.
Figure 3:
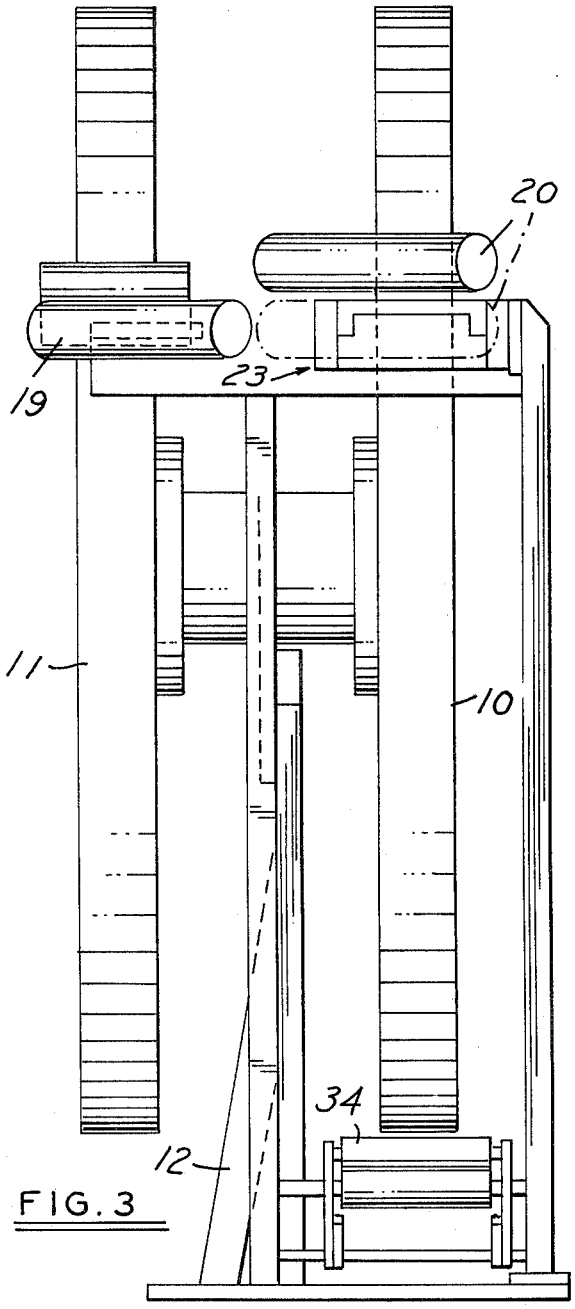
FIG. 3 is a partly diagrammatic end view.
Figure 5A:
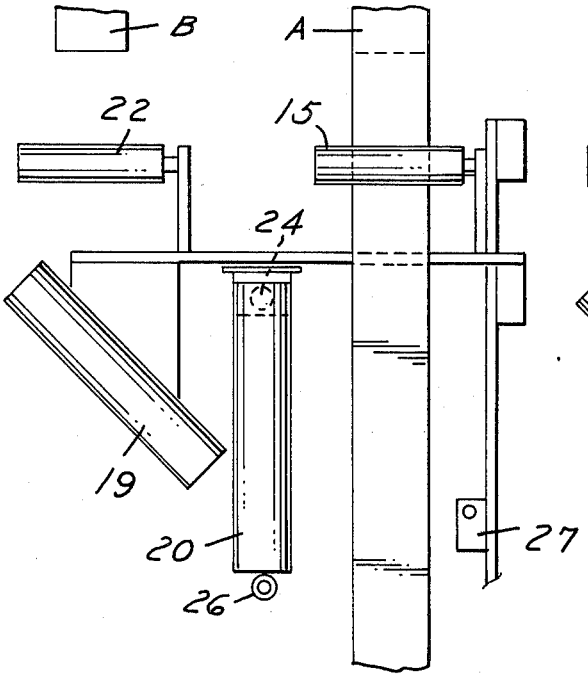
FIGS. 5A and 6A are partly diagrammatic plan views showing the apparatus in different positions.
Figure 6A:
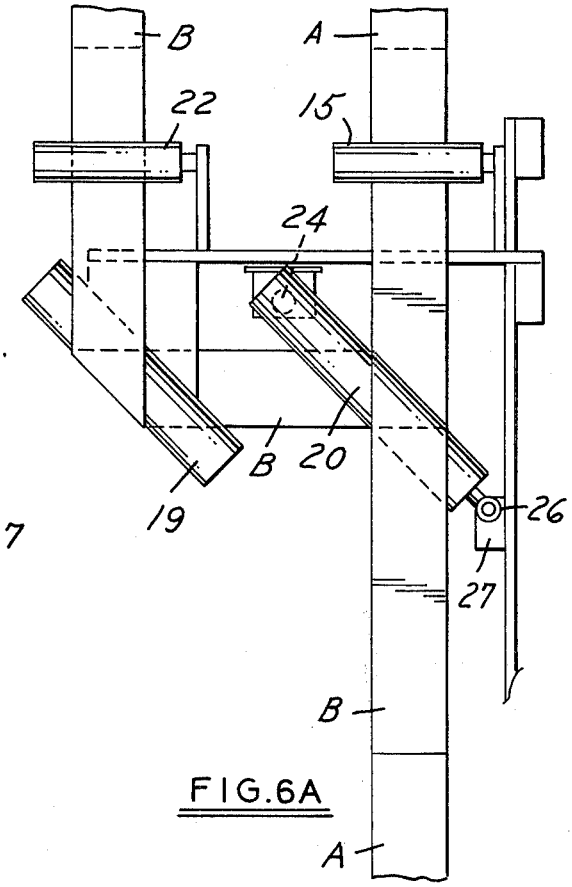

When a web A is being fed through the splicing station S to the production machine and it is desired to bring the leading end of the web B into position for splicing, the apparatus provides for movement of the turning bar 20 to a new position above the traveling web A. This is achieved by mounting the turning bar 20 on a shaft 24 for vertical movement along the axis of the shaft 24 and swinging movement horizontally about the axis of the shaft 24. A locking pin 25 (FIG. 4) normally extends through an opening in a bracket 26 on the turning bar 20 and an opening in a fixed bracket 27 on the frame to hold it in the normal position shown in FIG. 2. When the web A is traveling across the splicing station S and it is desired to bring the leading end of the web B from a new supply roll into position for splicing, the locking pin 25 is removed and the turning bar 20 is swung to the broken line position as viewed in FIG. 2, or in solid lines as viewed in FIG. 5A, 5B, elevated vertically, and swung back into position so that the lock pin 25 can be re-inserted through the eye of the bracket 26 into the opening in a fixed bracket 27 on the frame. The web B can then be manually trained over the turning bars 19, 20 so that the leading end of the web B is guided over the top surface of the web A that is being fed so that the splice can be made (FIGS. 3, 6A,B). After the splice is made, the turning bar 20 is lowered to its normal position and the web B continues to be fed to the production machine.

In order to facilitate the vertical movement of the turning bar 20, an actuator 28 is provided on the frame and includes an actuator arm 29 that engages the lower end of the shaft 24 to raise and lower the turning bar 20 as may be desired for the cycle.

As shown in FIG. 1, the festooning apparatus 17 comprises a plurality of rollers 30 mounted on the frame and rollers 31 mounted on a bar 32 pivoted to the frame 21. The web to be accumulated is fed over the rollers 30, 31 and then over a fixed guide roller 33 and a spring-loaded roller 34 to the production machine. During the splicing operation, when the web being fed across the splicing station is interrupted, a cylinder 35 progressively swings the bar 32 counterclockwise as viewed in FIG. 1, permitting the festooned web to continue to the production machine so that the operation of the machine is not interrupted. Upon completion of the splice, the cylinder 35 is actuated to return the bar 32 to its original solid line position as viewed in FIG. 1 so that a new supply of web can be accumulated for use in a subsequent splicing operation. An air source (not shown) supplies air to openings in the surface of turning bars 19, 20 to facilitate passage of web B over the surfaces of the turning bars.

Figure 5B:
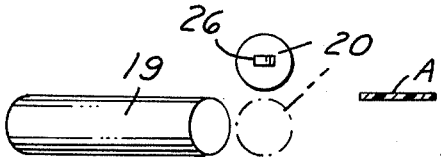
FIGS. 5B and 6B are fragmentary diagrammatic elevational views corresponding to the positions shown in FIGS. 5A and 6A, respectively.
Figure 6B:
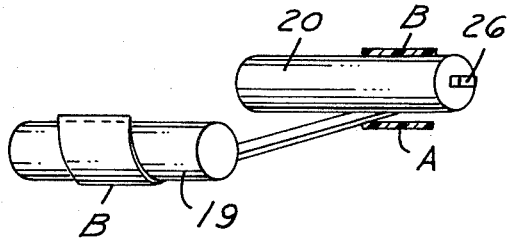
Figure 7:
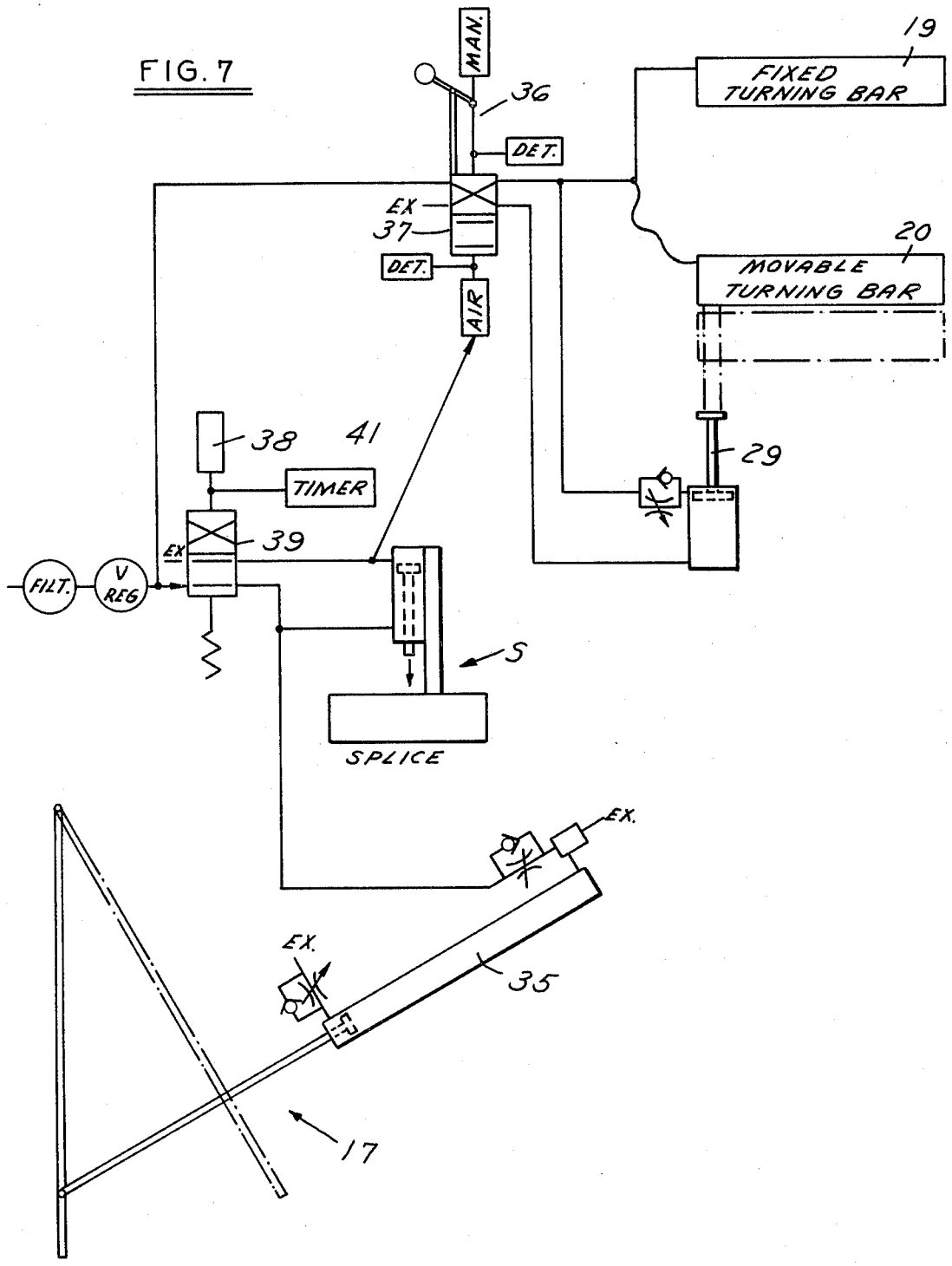
FIG. 7 is a schematic of the control circuit.

FIG. 7 shows a schematic diagram of the control circuit for the system. When a splice is to be initiated from a web B to the trailing end of a web A, the operator manually moves the turning bar 20 from its normal operative position to a position where its axis extends parallel to the web A (FIGS. 5A, 5B). The operator then operates the manual control 36 for an air valve 37 to supply air to the vertically oriented actuator 28 moving the actuator arm 29 to an elevated position thereby elevating turning bar 20. The operator then manually returns the turning bar to a position overlying the web A and manually trains the web B over the fixed and movable turning bars 19, 20 (FIGS. 3, 6A, 6B).

When the splice is to be made, the operator actuates a control 38 which operates a valve 39 to supply air to a valve that controls the operation of the splicer S shown diagrammatically. Valve 39 controls air exhausting from the festooning cylinder 35 permitting the cylinder to progressively move the stored supply of web A to the production machine while the splicing is occurring. A timer 41 provides a time delay and after a predetermined period supplies fluid to return the cylinder 35 to its original position. After the splice has been manually or automatically completed at the splicing station, the manual control 36 is returned to its original position and the actuator arm 29 is automatically retracted thus lowering the movable turning bar 20 and thereby permitting the normal operation of supply web B to the production machine.

It can thus be seen that a web handling apparatus has been provided which permits the webs from separate rolls to be fed across a splicing station and wherein the leading end of a web from a fresh roll is always supplied to the trailing end of a web from a roll which is supplying web on the same side of the web.

I claim:

1. A method of handling web rolls and permitting the splicing of the end of the web from one roll to the leading end of the web of another roll which comprises positioning a first roll for rotation about a horizontal axis, aligning a splicing station so that it receives a web from said first roll, positioning a second roll for rotation about a horizontal axis at a position spaced laterally of the first roll, positioning a pair of turning bars adjacent said webs such that the web from the second roll is turned in its direction so that it becomes longitudinally aligned with the web from the first roll, moving one of said turning bars from a position below the web from said first roll to a position above the web from said first roll such that the web from said second roll overlies the web from said first roll, feeding the web from the second roll into overlying relation with the web from the first roll at the splicing station so that the web from the second roll can be spliced to the web from the first roll, lowering said one turning bar to its lower position wherein the web from the second roll is aligned with the splicing station, and continuing the feeding of the web from the second roll past the splicing station.

2. A method of handling web rolls and permitting the splicing of the end of the web from one roll to the leading end of the web of another roll which comprises positioning a first roll for rotation about a horizontal axis, aligning a splicing station so that it receives a web from said first roll, positioning a second roll for rotation about a horizontal axis at a position spaced laterally of the first roll, positioning a pair of turning bars adjacent said webs such that the web from the second roll is turned in its direction so that it becomes longitudinally aligned with the web from the first roll, moving one of said turning bars from a position below the web from said first roll to a position above the web from said second roll such that the web from said second roll overlies the web from the first roll by pivoting said bar about a vertical axis to a position alongside the web from said first roll, elevating said first bar along said vertical axis and pivoting said first bar to a position above the web from said first roll, feeding the web from the second roll into overlying relation with the web from the first roll at the splicing station so that the web from the second roll can be spliced to the first web, lowering said one bar along said vertical axis to its lower position wherein the web from the second roll is aligned with the splicing station, and continuing the feeding of the web from the second roll past the splicing station.

3. A web handling apparatus comprising a first roll support for supporting a web roll for rotation about a horizontal axis, a second roll support for supporting a web roll about a horizontal axis generally parallel and spaced laterally from the first web roll, a frame, a splicing station on said frame, said first roll support being aligned with the splicing station such that the web from the first roll is fed longitudinally to and across said splicing station, a pair of turning bars on said frame, the first of said turning bars having its longitudinal axis positioned at an acute angle to the longitudinal axis of the web extending from the second roll for changing the direction of movement of the second roll web so that it extends transversely and toward the path of movement of the first roll web, the second of said turning bars having its longitudinal axis at an acute angle to the longitudinal axis of the second roll web for receiving that web from said first turning bar and changing its direction so that the second roll web moves in the direction of and parallel to the longitudinal axis of the first roll web, said second turning bar being pivotable about a vertical axis and movable vertically along said vertical axis such that the second bar can be moved from a position below the first roll web as it moves to the splicing station by pivotal movement of said second turning bar about the vertical axis and movement vertically upwardly and then pivoting about the vertical axis to a position wherein said second bar overlies the first roll web as it is moving toward the splicing station thereby permitting the second roll web to be trained over the turning bars to overlie the first roll web and be moved to the splicing station in overlying relation to said first roll web.

4. The web handling apparatus set forth in claim 3 including locking means for locking said second bar against pivotal movement.

5. The web handling apparatus set forth in claim 4 wherein said locking means comprises a fixed bracket having an opening, said second turning bar having a complementary opening and a removable pin insertable through the openings when they are aligned.

6. The web handling apparatus set forth in claim 3 including means for moving said second turning bar vertically upwardly along said vertical axis comprising an actuator.

7. The web handling apparatus set forth in claim 3 including festooning means downstream of said splicing station permitting interruption in the movement of a web for splicing by providing a supply of web to the machine which was being supplied from one of said rolls prior to the splicing.

* * * * *